United States Patent [19]

Jakubas

[11] Patent Number: 4,655,060

[45] Date of Patent: Apr. 7, 1987

[54] LOCKING DEVICE FOR TWO-HOLED DRUMS AND CONTAINERS

[75] Inventor: Gary Jakubas, Rutherford, N.J.

[73] Assignee: Taurus Precision, Inc., Fairfield, N.J.

[21] Appl. No.: 875,289

[22] Filed: Jun. 17, 1986

[51] Int. Cl.[4] ..... B65D 55/14

[52] U.S. Cl. ..... 70/230; 70/164

[58] Field of Search ..... 70/230, 229, 164, 165, 70/231

[56] References Cited

U.S. PATENT DOCUMENTS

| | | | |
|---|---|---|---|
| 1,599,685 | 9/1926 | Spaeth | 70/164 |
| 1,615,987 | 2/1927 | Loewer | 70/230 |
| 1,636,641 | 7/1927 | Lewis | 70/165 |
| 1,649,587 | 11/1927 | Halaby | 70/165 |
| 1,806,124 | 5/1931 | Smith | 70/230 |
| 1,814,343 | 7/1931 | Smith | 70/230 |
| 2,138,871 | 12/1938 | Malluk | 70/165 |
| 3,498,400 | 3/1970 | Hy Smith | 70/230 |
| 4,249,403 | 2/1981 | Littlejohn | 70/230 |
| 4,426,863 | 1/1984 | Gillette | 70/230 |

FOREIGN PATENT DOCUMENTS

| | | | |
|---|---|---|---|
| 86945 | 1/1922 | Austria | 70/165 |
| 1262388 | 4/1961 | France | 70/165 |

*Primary Examiner*—Henry E. Raduazo

*Attorney, Agent, or Firm*—Ronald G. Goebel

[57] ABSTRACT

This invention is concerned with a locking device for a drum which seals and locks the bung hole and vent hole of 35 or 55 gallon drums to prevent unauthorized access thereto. The device includes two swivel locks, each consisting of a lock cap containing an externally threaded base and a swivel and a lock bar.

After the swivel locks are threaded into the bung hole and vent hole, the swivels are rotated until their holes align. A lock bar having a flanged end of greater width than the hole of the swivel and a hole at its other end is passed through the holes. The shackle of a padlock or other locking device is then passed through the lock bar hole and locked. Means for rotatably retaining the swivel in the lock cap are also provided.

4 Claims, 9 Drawing Figures

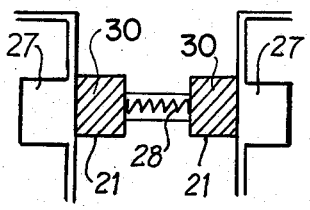
FIG.4
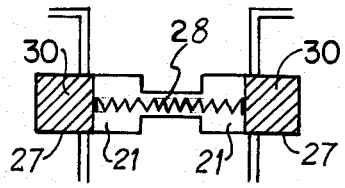
FIG.4a
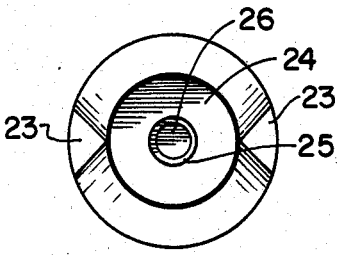
FIG.5
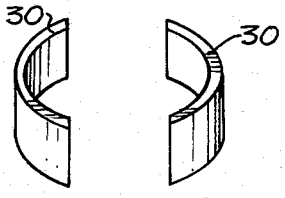
FIG.6
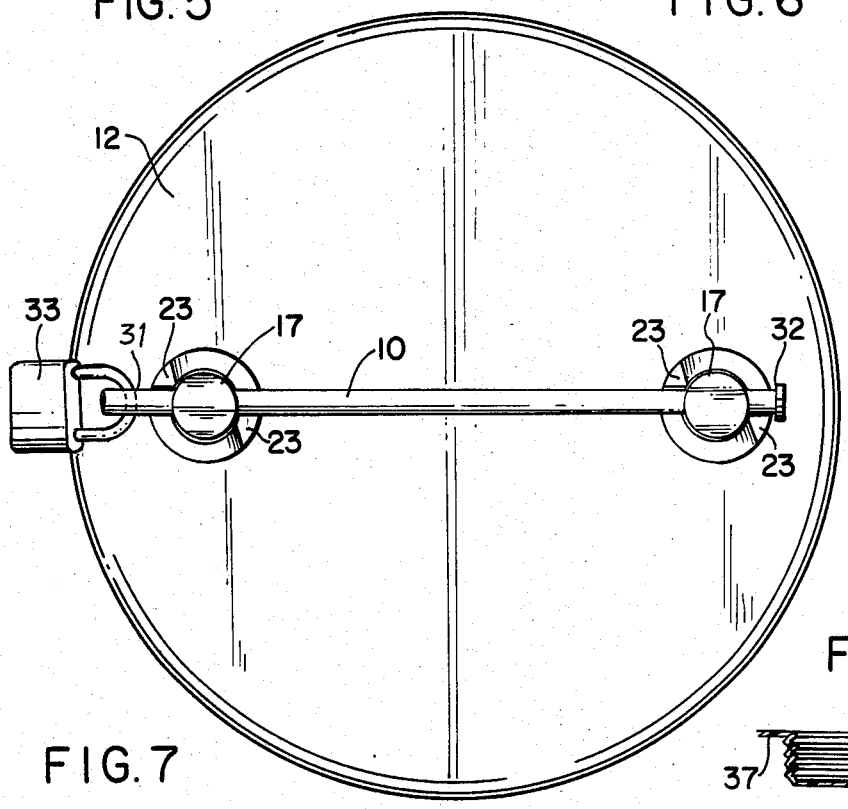
FIG.7
FIG.8
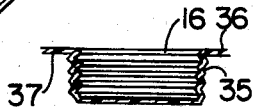

LOCKING DEVICE FOR TWO-HOLED DRUMS AND CONTAINERS

BACKGROUND OF THE INVENTION

This invention is concerned with a locking device for a drum.

Drums containing pharmaceuticals, petroleum products, liquid chemicals and the like are usually provided with a bung hole and a vent hole in their top portion or cover. These holes are generally plugged with threadable plugs to prevent leakage. However, such drums are often subject to contamination and theft of its contents while in storage and it is highly desirable to provide means to prevent unauthorized access to such drums.

In the past devices have been proposed to effect such unauthorized access.

For example, in U.S. Pat. No. 1,599,685 to C. Spaeth a closure member for metal containers is described having a flat top and a flanged portion to enable a wrench to be engaged. The member has a cylindrical body portion threaded internally and externally which is adapted to be threaded into the threaded opening of a seating and connecting ring or collar. A stud having an eye is secured to the top of the closure adapted to receive the shackle of a padlock. A smaller horizontal opening is formed within the stud at right angles to the eye opening. A closing cover is fitted over the top of the closure member to prevent the stud from being engaged by a wrench when not desired, if a padlock is used in the eye.

In U.S. Pat. No. 1,806,124 to W. H. Smith a locking device for a container having a bung plug and a vent plug is provided. A top plug is threaded into the bung and vent plugs, each top plug having an eye. Two rods having rings at both ends, are slid through the eye of each top plug and the inner rings of each rod are connected by a padlock.

The present invention, on the other hand, provides an efficient and effective locking device for drums and other containers containing two alignable openings which is easy to install.

SUMMARY OF THE INVENTION

In brief, the invention comprises a locking device which seals and locks the bung hole and vent hole of 35 or 55 gallon drums to prevent unauthorized access thereto. The device includes two swivel locks, each consisting of a lock cap containing an externally threaded base and a swivel. The swivel locks are identical in structure except for the diameter of the base to accomodate the different sizes of the bung hole and vent hole. The body portion of the lock cap has a central base and an internal groove surrounding the base. A swivel having a cylindrical top and a shaft is rotatably mounted on the lock cap. The shaft is fittable within the base and has an external groove which mates or communicates with the internal groove when the swivel is combined with the lock cap. An axial channel is formed in the shaft at the level of the external groove. In order to rotatably retain the swivel in the lock cap a keeper spring and two keeper plates having the contour of the internal and external grooves and the width of the external groove is employed. Before assembling the swivel and lock cap the spring is inserted in the channel and the keeper plates placed in the external groove of the shaft of the swivel. When the internal and external grooves mate the outwardly biased spring pushes the keeper plates partially into the internal groove. The width of the internal groove of the lock cap body permits only about half of the keeper plate width to enter the internal groove causing an axial interference between the swivel and the lock cap body so that the swivel is rotatably retained in the lock cap body.

After the swivel locks are threaded into the bung hole and vent hole, the swivels are rotated until their holes align. A lock bar having a flanged end of greater width than the hole of the swivel and a hole at its other end is passed through the swivel holes. The shackle of a padlock, security seal, or other locking device is then passed through the lock bar hole and locked. If an attempt is made to unscrew one or both lock caps the upstanding lugs on the lock cap will abut the lock bar within one half turn and prevent any further turning.

In the case of drums containing corrosive materials, a sleeve made of non-corrosive plastic may be fitted or threaded over the base portions of each lock cap and threaded into the drum openings.

BRIEF DESCRIPTION OF THE DRAWINGS

FIGS. 4 & 4*a* are enlarged sectional views of the inner bore of the lock cap showing installation and operation of a retaining means for said swivel;

FIG. 5 is a top view of the lock cap;

FIG. 6 is a perspective view of keeper plates used as retaining means for the swivel;

FIG. 7 is a top view of the locking device on a drum showing the prevention of unscrewing the swivel locks; and FIG. 8 shows a side view of a lock cap having a sleeve secured to the base portion thereof.

DETAILED DESCRIPTION OF THE PREFERRED EMBODIMENTS

Figure 1:
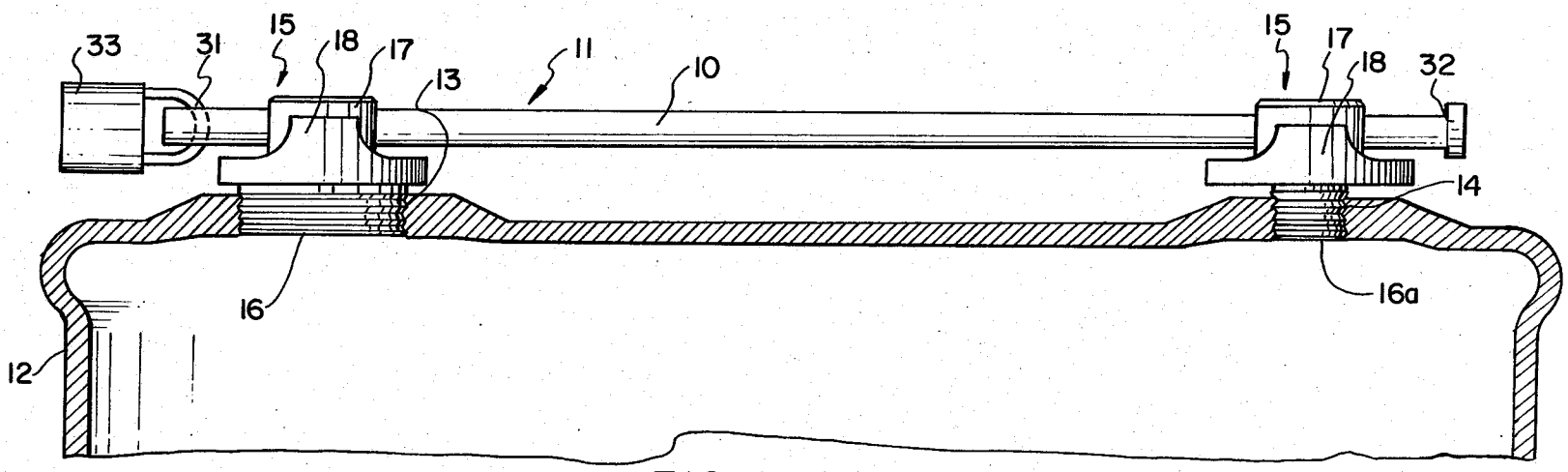
FIG. 1 shows a top section of a drum with the locking device installed thereon.
Figure 3:
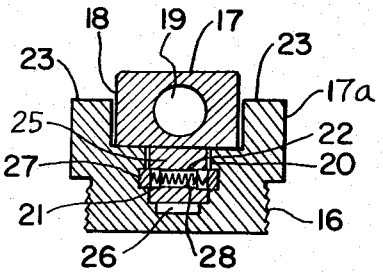
FIG. 3 is a side sectional view of said swivel lock.
Figure 2:
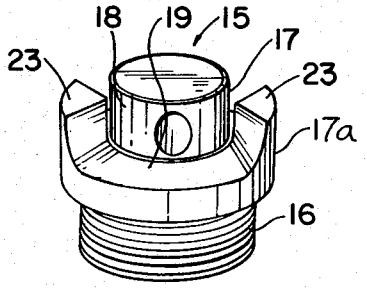
FIG. 2 shows the swivel lock component of the locking device consisting of a swivel and lock cap.

Referring to FIG. 2 the locking device of the invention is shown generally by 11 mounted on a drum 12 such as a 35 or 55 gallon chemical drum, shown in FIG. 1 as the top portion thereof. The drum has a relatively large internally threaded bung hole 13 on one of its top sides and a relatively small internally threaded vent hole 14 oppositely disposed on its other side. The device of the invention includes three main elements; two swivel locks indicated generally by 15 having externally threaded base portions 16 and 16*a* which threadably engage bung hole 13 and vent hole 14, respectively, and a lock bar 10. All elements are preferably made of free machining brass to prevent corrosion and prolong wear. Optionally, however, they may be made of a cast brass, malleable cast iron, plastic, stainless steel, or zinc or chrome plated metal. Each swivel lock is identical in structure except for the size of the base portions 16 and 16*a*. Only one swivel lock is shown in FIGS. 2 to 4 for purposes of illustration.

Each swivel lock comprises a top swivel 17 and a lock cap 17*a* having externally threaded base portions 16 and 16*a*. Referring now to FIGS. 2 to 6, the swivel 17 consists of a cylindrical top 18 having circular hole 19 through which lock bar 10 can pass. The lower portion consists of a cylindrical shaft 20 having an external annular groove 21 formed therein. A channel 22 extends through the shaft at the level of the external annular groove, the function of which will be discussed hereafter.

Each lock cap 17*a* has formed therein a pair of raised lugs 23 in its upper body portion and has a flat circular face 24 upon which cylindrical top 18 is slidably supported. A central cylindrical bore 25 extends from this face into the lock cap body terminating in an air well 26 of somewhat smaller diameter.

An internal annular groove 27 is formed in the body which mates or communicates with groove 21 in the swivel when the swivel is placed on the lock cap. When so combined the swivel can freely rotate inside the lock cap. The width of the internal annular groove 27 is less than the width of external annular groove 21.

In order to prevent the swivel from being removed from the lock cap, a keeper spring 28 is inserted in channel 22 before assembly of the swivel and lock caps. Then two curved keeper plates 30 as shown in FIG. 6 having the curved contour of the grooves 27 and 21 and the width of groove 21 are placed inside annular groove 21 and the swivel is placed inside the lock cap as shown in FIG. 4. As the external groove 21 of the swivel aligns with the internal groove 27 of the lock cap, the outwardly biased spring 28 pushes the keeper plates into groove 27 as shown in FIG. 4*a*. Since the width of groove 27 is less than that of groove 21 each keeper plate extends partially into groove 27. In such position the swivel is prevented from being removed from the lock cap while at the same time being allowed to rotate therewithin.

In use the larger base diameter swivel lock is threaded into bung hole 13 and the smaller swivel lock is threaded into vent hole 14. The swivels 17 are placed inside the lock caps 18 with the keeper spring and plate as described above to retain the swivel. Then the swivels are rotated to place the hole 19 of each in a linear relationship. The lock bar 10 is equipped with locking hole 31 at one end and flange 32 at the other, the flange diameter being greater than the diameter of hole 19. The end of the bar containing the locking hole is slid through the hole in each swivel lock. The shackle of a padlock 33 is passed through hole 31 in the lock bar and locked. The lock bar is thus prevented from being removed from the swivel by virtue of the padlock and flange.

If an attempt is made to unscrew the lock caps, the lugs 23 of the lock caps will impinge upon the lock bar within one half turn thus preventing any further unscrewing. This is shown in FIG. 7.

FIG. 8 shows still another embodiment of the invention which is useful for locking drums containing corrosive liquids such as acids and the like. In this embodiment a threaded sleeve 35 made of an anti-corrosive material such as Teflon or other plastic is threaded over the base portion 16 of the lock cap. The sleeve also has upper face 36 which contacts the lower face 37 of the lock cap. The sleeve 35 is externally threaded to engage the threaded of the bung hole and vent hole.

I claim:

1. A locking device for a container having first and second openings comprising:

(a) first and second lock caps each having a base portion for insertion in said first and second openings respectively, a body portion having a central bore and upstanding lugs;

(b) a swivel rotatably mounted on each said lock caps comprising a top section having a hole extending therethrough and a shaft rotatably and slidably fitted into said central bore of said lock cap;

(c) means for rotatably retaining said swivel in each of said lock caps; and (d) a locking bar extending through said central hole of each said swivel having means for retaining said bar in one of said holes at one end and means for locking said bar at the other end.

2. The locking device of claim 1 wherein said means for retaining said swivel in each of said lock caps comprises:

(e) an internal groove in said body portion of said lock cap;

(f) an external groove in said shaft which communicates with said external groove when said swivel is combined with said lock cap, said shaft having a channel extending therethrough;

(g) outwardly biased spring means located in said channel; and (h) curved keeper plates contacting said spring means and retained in a position between said external and internal grooves.

3. The locking device of claim 1 which further comprises a sleeve covering each of said base portions.

4. A locking device for a container having first and second internally threadable openings comprising:

(a) first and second lock caps, each having an externally threaded base portion for threadable insertion into said first and second openings, respectively, a central cylindrical bore and an internal annular groove surrounding said bore and upstanding lug members;

(b) a swivel rotatably mounted on said lock cap comprising a cylindrical top section having a hole extending therethrough and a cylindrical shaft located under said top section having an annular external groove inserted in said central cylindrical bore, a channel extending radially through said shaft at said external groove, whereby said internal and external grooves are in communication; outwardly biased spring means located in said channel and curved keeper plates contacting said spring means and extending between said internal and external grooves; and (c) a locking bar extending through said central hole of each of said swivels having flange means at one end to prevent complete passage of said bar through said one hole and a hole at the other end thereof for insertion of locking means.

* * * * *